US006193148B1

(12) United States Patent
Shimada

(10) Patent No.: US 6,193,148 B1
(45) Date of Patent: Feb. 27, 2001

(54) FOLDING TYPE BOX-SHAPED CONTAINER

(75) Inventor: Masaharu Shimada, Hatsukaichi (JP)

(73) Assignees: Tohsho Logitech Kabushiki Kaisha; Kabushiki Kaisha Fukutomi, both of Hiroshima (JP)

( * ) Notice: Subject to any disclaimer, the term of this patent is extended or adjusted under 35 U.S.C. 154(b) by 0 days.

(21) Appl. No.: 09/320,137

(22) Filed: May 26, 1999

(51) Int. Cl.[7] ..... B65D 35/24

(52) U.S. Cl. ..... 229/104; 229/109; 229/122.29; 229/122.31; 229/122.33; 229/122.34

(58) Field of Search ..... 229/5.5, 104, 108, 229/109, 110, 122.27, 122.29, 122.31, 122.32, 122.33, 122.34

(56) References Cited

U.S. PATENT DOCUMENTS

| | | | | |
|---|---|---|---|---|
| 1,156,444 | * | 10/1915 | Stevens | 229/122.29 |
| 1,926,941 | * | 9/1933 | Gomes | 229/122.32 |
| 1,969,030 | * | 8/1934 | Page | 229/5.5 |
| 2,726,803 | * | 12/1955 | Ketler | 229/122.29 |
| 2,780,402 | * | 2/1957 | Zucker et al. | 229/5.5 |
| 4,166,568 | * | 9/1979 | Swan | 229/5.5 |
| 5,050,775 | * | 9/1991 | Marquardt | 229/110 |

FOREIGN PATENT DOCUMENTS

| | | | | |
|---|---|---|---|---|
| 603044 | * | 8/1960 | (CA) | 229/5.5 |
| 3-27940 | | 6/1991 | (JP) . | |
| 7-32416 | | 7/1995 | (JP) . | |

* cited by examiner

*Primary Examiner*—Gary E. Elkins
(74) *Attorney, Agent, or Firm*—Wenderoth, Lind & Ponack, L.L.P.

(57) ABSTRACT

This invention pertains to a folding type box-shaped container comprising a container body having a hollow member whose top portion and bottom portion are open, a bottom member removably attached to the bottom portion of the hollow member, and a lid member being fitted onto the top portion of the hollow member. The hollow member has a cross-sectional form of a polygon having N sides, where N is an integer of 4 or more, when the hollow member is cut through a plane perpendicular to an axial line thereof. The hollow member has side surface portions in the number of N, and has lingual portions each of which extends from a lower end portion of the side surface portion. Each lingual portion is folded back inwardly and has two sides and an end. The bottom member having a flat plate portion having a flat form of a polygon having N sides and being analogous to the cross-sectional form of the hollow member, and side wall portions that extend downwardly from the sides of the flat plate portion, with each side wall portion of the bottom member being received within a space formed between each side surface portion and lingual portion of the hollow member. The flat plate portion of the bottom member is to be supported by the ends of the lingual portions, when the folding type box-shaped container is assembled.

29 Claims, 13 Drawing Sheets

FOLDING TYPE BOX-SHAPED CONTAINER

BACKGROUND OF THE INVENTION

The present invention relates to a folding type box-shaped container which can be easily assembled and disassembled and which is not bulky in a disassembled state.

As a container, e.g., for foods, chemicals and the like, for example, Japanese Utility Model Publications Nos. JP-Y2-3-27940 and JP-Y2-7-32416 disclose cylindrical containers. These containers have a container body formed by attaching a bottom member 2 made of paper or aluminum to a lower end of a cylindrical member 1 made of paper as shown in FIG. 20. And, a ring member 3 is embedded in a circumferential portion of an upper end of the cylindrical member 1 which is open, and a circularid member 4 is fitted into the ring member 3.

The cylindrical member 1 made of paper is fabricated by consecutively winding a kraft paper 6 around a roll 5 which is rotating in the direction of "B" as shown in FIG. 21. The kraft paper 6 has the form of a roll when supplied. An adhesive is applied to the inner surface of the kraft paper 6 which is taken up around the roll 5, with an adhesive applicator roll 7. That is, an adhesive feed roll 8 turns while it is in contact with the adhesive applicator roll 7, so that the adhesive feed roll 8 feeds a roll surface of the adhesive applicator roll 7 with an adhesive at a constant rate. As a result, the adhesive is applied to the kraft paper 6 which is passed in the direction of "C", with the adhesive applicator roll 7. While the kraft paper 6 is taken up around the roll 5, the cylindrical member 1 is fabricated. The container body having the above-fabricated cylindrical member 1 has high durability due to a multi-layered kraft paper even in a state where an external force is exerted onto a side portion in the direction of an arrow "A" shown in FIG. 20, against drop and collapse thereof.

Further, a cylindrical container wholly made of paper, shown in FIG. 22, is also known as a conventional container. The container has an internal cylindrical member 9 having a bottom, an external cylindrical member 10 and aid member. The internal cylindrical member 9 and the external cylindrical member 10 are engaged with each other, and the internal cylindrical member 9 has its upper portion projected above the external cylindrical member 10. The lid member has a circular flat plate portion 11and a side wall portion 12 extending downward from the circumferential edge of the circular flat plate portion 11. The side wall portion 12 is formed of a band-like member made of paper, and the side wall portion 12 is bonded to the circumferential edge of the circular flat plat portion 11 with an adhesive. The lid member is fitted onto the upper portion of the internal cylindrical member 9 which is projected from the external cylindrical member 10.

The above conventional cylindrical containers are shipped, for example, in a state where a chemical or a food are packed in, and such products are distributed from a supplier to an end user. When they are recycled, they are difficult to be folded, so that the cylindrical containers have a problem in that they are bulky. That is, it is difficult to flatten the cylindrical body portions of the above cylindrical containers, and when they are recycled to a shipping plant, they are bulky and require an additional transportation cost. Further, end users have a problem in that since the cylindrical containers have durability in the direction of the arrow "A" in FIG. 20, they cannot be flattened. Even when the above conventional cylindrical containers are disposed of as a waste, it takes time to destroy them since they have some strength.

SUMMARY OF THE INVENTION

It is therefore an object of the present invention to provide a folding type box-shaped container which easily permits assembling and disassembling, and which is not bulky in a disassembled state so that it can be easily transported or disposed of as a waste.

According to the present invention, the above object of the present invention is achieved by a folding type box-shaped container comprising a container body having a hollow member whose top portion and bottom portion are open, and a bottom member removably attached to the bottom portion of the hollow member, and a lid member being fitted onto the top portion of the hollow member, the hollow member having a cross-sectional form of a polygon having N sides, where N is an integer of 4 or more, when the hollow member is cut through a plane perpendicular to an axial line thereof, having side surface portions in the number of N, and having lingual portions each of which extends from a lower end portion of the side surface portion, is folded back inward and has two sides and an end, the bottom member having a flat plate portion having a flat form of a polygon having N sides and being analogous to the cross-sectional form of the hollow member, and side wall portions extending downward from the sides of the flat plate portion, and each side wall portion of the bottom member being to be received in a space formed between each side surface portion and lingual portion of the hollow member, and the flat plate portion of the bottom member being to be supported by the ends of the lingual portions, when the folding type box-shaped container is assembled.

In the folding type box-shaped container of the present invention, preferably, the side of the lingual portion of the hollow member which is folded inward is engaged with the side of the adjacent lingual portion, when the folding type box-shaped container is assembled. In this case, the inwardly folded lingual portions can be prevented from falling down toward the axial line of the hollow member. Alternatively, in the folding type box-shaped container of the present invention, each lingual portion has at least one projection on the end thereof, and the flat plate portion of the bottom member has holes in which the projections are to be fitted. This configuration is preferred in view of accomplishing the reliable fitting of the lingual portions and the bottom member and preventing the lingual portions from falling down toward the axial line of the hollow member.

In the folding type box-shaped container of the present invention, the lid member preferably has a flat plate portion having a flat form of a polygon having N sides and being analogous to the cross-sectional form of the hollow member, and side wall portions extending downward from the sides of the flat plate portion. When the lid member is covered on the top portion of the hollow member, preferably, the inner surfaces of the lid member and the outer surfaces of top portion of the hollow member are brought into contact such that the gaps therebetween are as small as possible.

In one preferred embodiment of the folding type box-shaped container of the present invention, preferably, the folding type box-shaped container further has an internal hollow member housed in the hollow member for improving the strength of the folding type box-shaped container on assembling and for improving the sealability of the folding type box-shaped container. Preferably, the lower end of the internal hollow member is supported on the flat plate portion of the bottom member, the internal hollow member has its upper portion projected above the top portion of the hollow member, and the projected upper portion of the internal hollow member is fitted with the lid member. In this case, preferably, the lower ends of the side wall portions of the lid member and the top end of the hollow member are in contact with each other at least partly in a state where the lid member is fitted onto the internal hollow member, i.e., in a state where the container body is closed with the lid member.

In the folding type box-shaped container of the present invention, preferably, N=2m is satisfied where m is an integer of 2 or more, in view of an easiness in folding the folding type box-shaped container.

In the folding type box-shaped container of the present invention, a band-like member can be used for the hollow member, and the hollow member can be fabricated by providing one end of the band-like member with a connection margin, stacking the connection margin on the other end portion of the band-like member and bonding these to each other. Further, the band-like member for the hollow member is preferably provided with bending lines for sectioning it into the side surface portions and sectioning the connection margin from the adjacent side surface portion, which bending lines are preferred for fabricating the hollow member. Further, the band-like member for the hollow member is preferably provided with folding-back lines for sectioning the band-like member into the lower end portions of the side surface portions and the lingual portions and other folding-back lines which are adjacent to, and in parallel with, the former folding-back lines, which folding-back lines of two types are preferred for reliably forming the spaces for receiving the side wall portions of the bottom member between the side surface portions and the folded lingual portions of the hollow member. The distance between one folding-back line and the other folding-back line can be, for example, nearly equal to the thickness of each side wall portion of the bottom member.

When the folding type box-shaped container of the present invention is assembled, the lingual portions extending from the lower end portions of the side surface portions are folded inwardly to form the spaces having a "U"-shape between the lingual portions and the side surface portions in advance. And, while the side wall portions of the bottom member are arranged to face downward, the bottom member is inserted into the hollow member through the opening portion on the top portion of the hollow member, and the side wall portions of the bottom member are received in the above spaces having the "U" shape and the flat plate portion of the bottom member is supported on the ends of the lingual portions. The lingual portions which are folded inward can be prevented from falling toward the axial line of the hollow member when the side of the lingual portion of the hollow member is engaged with the side of the adjacent lingual portion, or when the end of the lingual portion is provided with at least one projection and the holes in which the projections are to be fitted are provided in the flat plate portion of the bottom member. A state where "the side of the lingual portion of the hollow member is engaged with the side of the adjacent lingual portion" includes a state where the side of the lingual portion of the hollow member is engaged with part of the adjacent lingual portion which part is in the vicinity of the side of the lingual portion.

When the folding type box-shaped container of the present invention is disassembled, the side wall portions of the bottom member are withdrawn from the spaces having the "U" shape, and further, the bottom member is taken out of the opening portion on the top portion of the hollow member. For transporting the folding type box-shaped container, the hollow member can be folded flat.

The hollow member, the bottom member, the lid member and the internal hollow member can be produced, for example, from a corrugated board material made of paper, a corrugated board material made of a plastic, or a paper material prepared by laminating inserting paper and paper board(s). The hollow member, the bottom member and the lid member can be formed of one material, materials of the same type or different materials.

BRIEF DESCRIPTION OF THE DRAWINGS

The folding type box-shaped container of the present invention will be explained with reference to Examples hereinafter.

DESCRIPTION OF THE PREFERRED EMBODIMENTS

EXAMPLE 1

Figure 1:
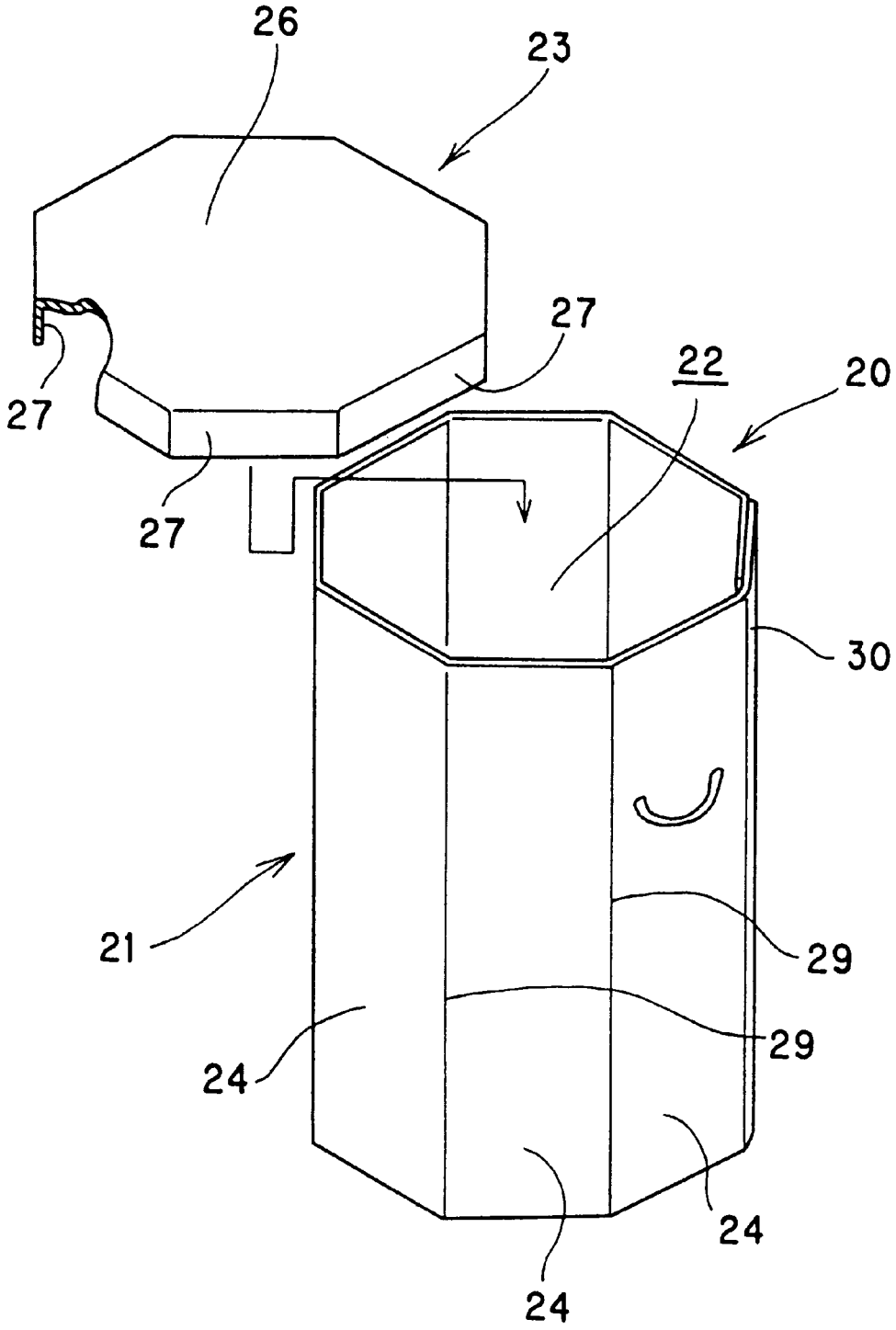
FIG. 1 is a perspective view of the whole of a folding type box-shaped container of Example 1 in which part thereof is cut off.

FIGS. 1 to 9 show a folding type box-shaped container of Example 1. As shown in a perspective view of FIG. 1 in which part is cut off and in a schematic cross-sectional view of FIG. 4, the folding type box-shaped container of Example 1 comprises a container body 20 and a lid member 23. The container body 20 has a hollow member 21 of which the top and the bottom are open, and a bottom member 25 removably attached to the bottom portion of the hollow member 21. The lid member 23 is for being fitted onto the top portion of the hollow member 21 and closing an opening portion 22 of the hollow member 21. The hollow member 21, the bottom member 25 and the lid member 23 are made of a corrugated paper board material.

Figure 6:
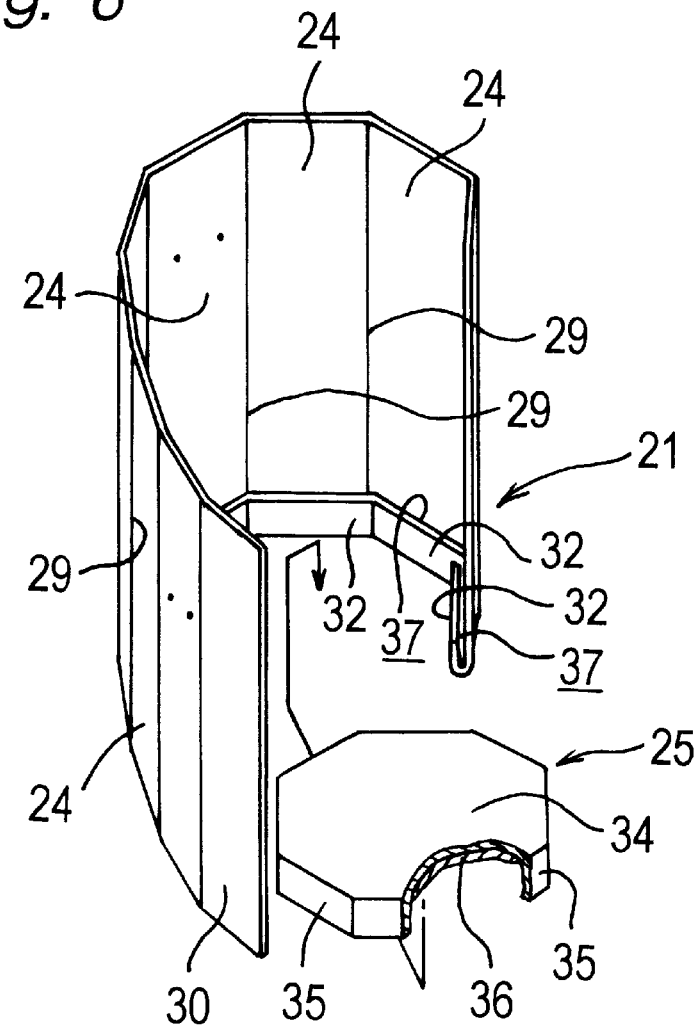
FIG. 6 is a perspective view showing a process of assembling a container body.
Figure 7:
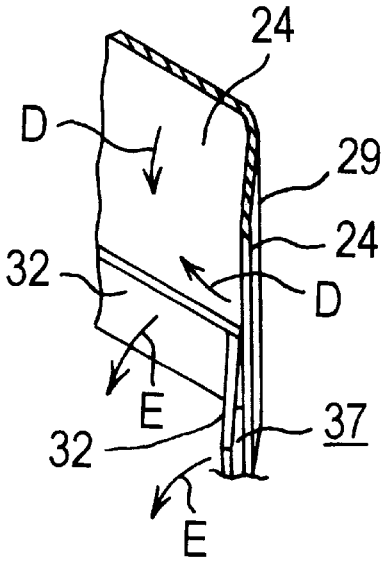
FIG. 7 is a perspective view of a partially cut portion, showing a state where adjacent lingual portions are engaged with each other.

The hollow member 21 has an octagonal cross section (N=8) when cut through a plane perpendicular to its axial line. The hollow member 21 has eight side surface portions 24 and lingual portions or tongues 32 having two sides and an end. Each lingual portion 32 extends from a lower end portion or tongue of the side surface portion 24 and is folded back inwardly. The hollow member 21 is formed by bending a band-like member made of a corrugated paper board material shown in a development of FIG. 8. The band-like member is provided with bending lines 29 at predetermined intervals for sectioning the band-like member into the side surface portions 24. Further, one end (left end portion in FIG. 8) of the band-like member has a connection margin 30, and a bending line 29 is also provided between the connection margin 30 and the side surface portion 24 adjacent thereto. Further, the hollow member 21 has the lingual portions 32 extending from the lower end portions of the side surface portions 24. The lingual portions 32 are formed by providing the lower end portions of the side surface portions 24 with slits 33 continued from the bending lines 29, and each lingual portion 32 has two sides and an end (see FIG. 8). For easily folding the lingual portions 32 back inwardly as shown in FIG. 6, two folding-back lines 34A and 34B are provided between each lingual portion or tongue 32 and each side surface portions 24 (see FIG. 8). The lower end portions of the side surface portions 24 and the lingual portions 32 are sectioned with the folding-back lines 34A, and the folding-back lines 34B are provided adjacently to, and in parallel with, the folding-back lines 34A and in parallel with the ends of the lingual portions 32.

Figure 8:
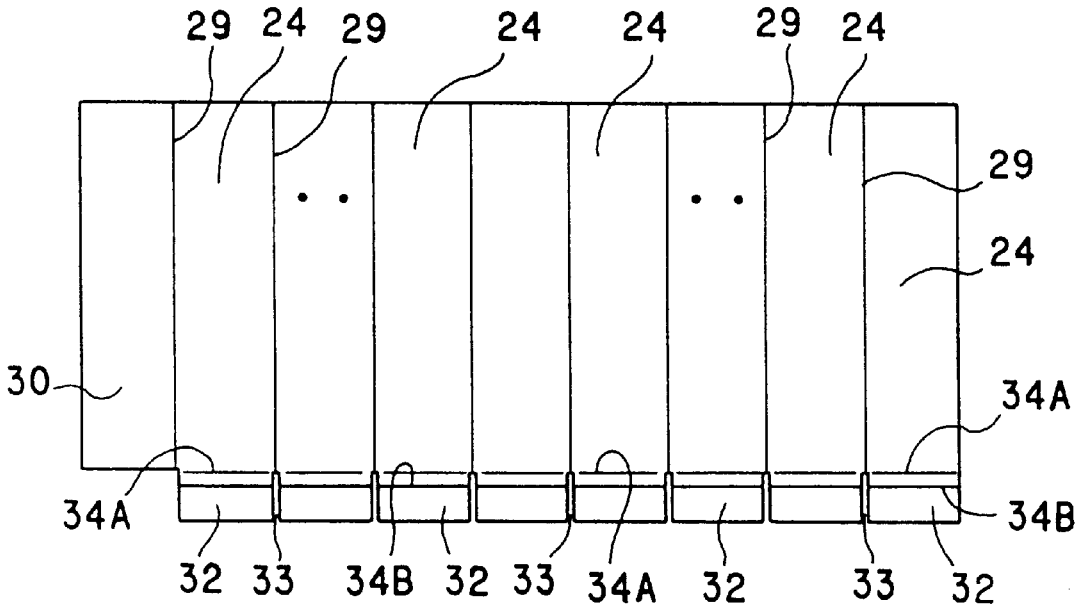
FIG. 8 is a development of a hollow member in Example 1.

When the hollow member 21 is fabricated, first, each lingual portion 32 in a developed state shown in FIG. 8 is folded inward along the folding-back lines 34A and 34B in the shape of the letter U. Further, the band-like member is bent inwardly along the bending lines 29 as shown in FIG. 6. The sides of each lingual portion 32 which is folded back in the shape of the letter U are engaged with the sides of the adjacent lingual portions 32 which are also folded back in the shape of the letter U (see FIG. 7). Further, in the above engaged state, mutually adjacent side surface portions 24 are bent along the bending lines 29 in the direction of an arrow "D" (see FIG. 7), i.e., in such a direction that the side surfaces 24 come nearer with each other, and the side of the fitting lingual portion 32 therefore comes to "eat in" the side of the adjacent lingual portion 32. As a result, the lingual portions 32 are prevented from falling down in the direction of an arrow "E" in FIG. 7, i.e., toward the axial line of the hollow member. The slits 33 provided in the band-like member may be broadened to some extent such that the sides of the adjacent lingual portions 32 which are folded back in the shape of a U-letter are engaged with each other when the side surface portions 24 are bent along the bending lines 29 in the direction of the arrow "D" (see FIG. 7).

An adhesive is applied to the inner surface of the connection margin 30 on one end of the band-like member in advance. The band-like member is bent inwardly along the bending lines 29 (see FIG. 6), and the connection margin 30 and the outer surface of the side surface portion 24 of the other end are attached to each other to bond the connection margin 30 to the side surface portion 24. In the above manner, the hollow member 21 can be fabricated.

Figure 2:
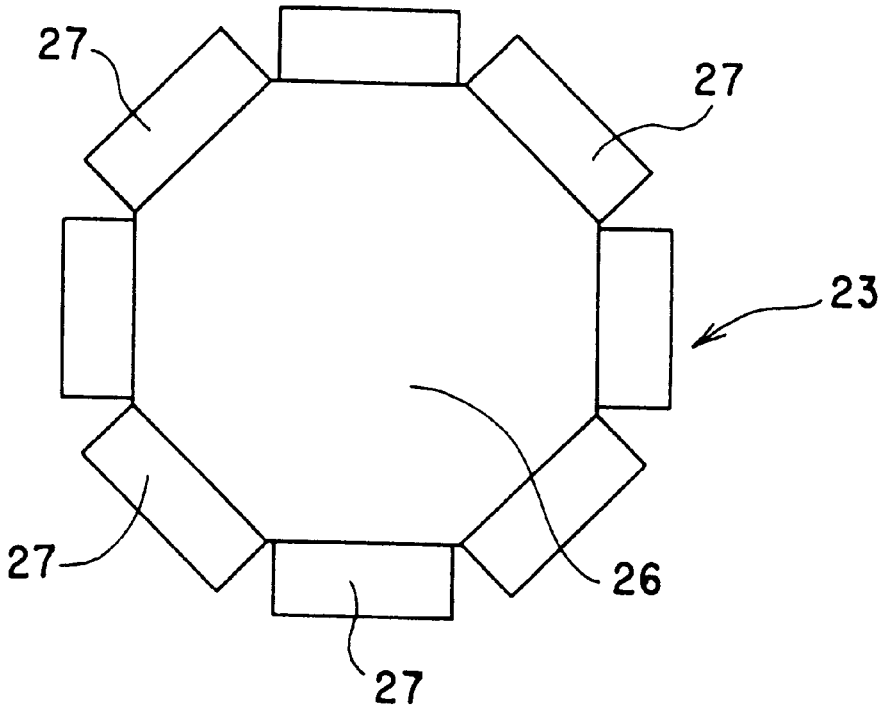
FIG. 2 is a development of a lid member in Example 1.
Figure 3:
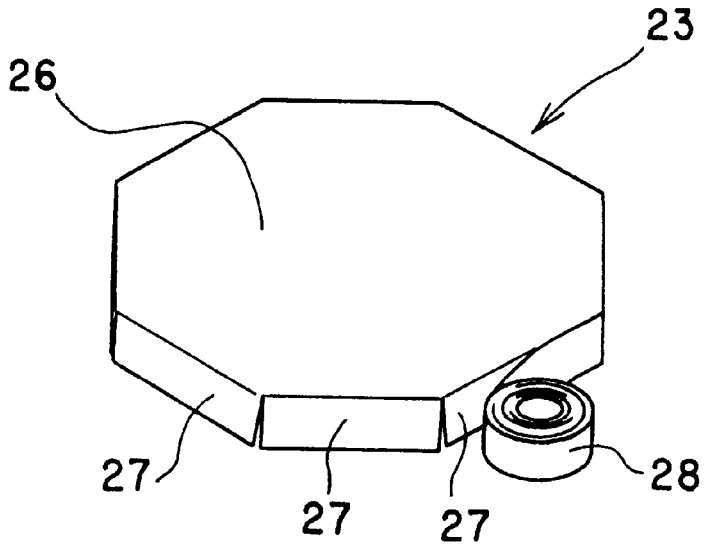
FIG. 3 is a perspective view of the lid member being fabricated in Example 1.

The lid member 23 has a flat plate portion 26 having an octagonal flat form nearly analogous to the cross-sectional form of the hollow member 21 and side wall portions 27 extending downwardly from the sides of the flat plate portion 26. FIG. 2 shows a schematic plan view of the lid member 23 which is developed before fabricating. FIG. 3 shows a schematic perspective view of the lid member 23 during the fabricating. The side wall portions 27 extending from the sides of the octagonal flat plate portion 26 are bent downwardly, and a paper tape 28 is wound along the outer surfaces of the side wall portions 27, whereby the lid member 23 can be fabricated. When the lid member 23 having the above structure is put on the top portion of the hollow member 21, the inner surfaces of the side wall portions 27 of the lid member 23 and the outer surfaces of the hollow member 21 on its top portion contact with each other with forming almost no gap, whereby the opening portion 22 of the hollow member 21 is closed while the flat plate portion 26 of the lid member 23. The above paper tape 28 may be replaced with a band or the like to fabricate the lid member 23.

Figure 5:
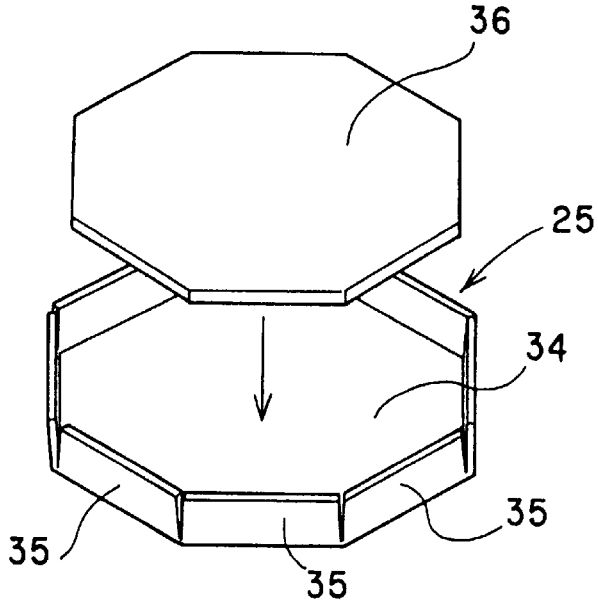
FIG. 5 is a perspective view of a bottom member being fabricated in Example 1.

As an exploded perspective view shown in FIG. 5, the bottom member 25 has a flat plate portion 34 having an octagonal flat form nearly analogous to the cross-sectional form of the hollow member 21 and side wall portions 35 extending downwardly (upwardly in FIG. 5) from the sides of the flat plate portion 34. The developed state of the bottom member 25 is substantially the same as that shown in FIG. 2 except that the dimensions thereof differ. A paperboard support member 36 made of an octagonal corrugated paper board material having a slightly smaller outer shape than the flat plate portion 34 is bonded to the lower surface of the flat plate portion 34 for increasing the strength of the bottom member 25. The paperboard support member 36 preferably has a size such that the end portions of the lingual portions 32 are received or secured in spaces between the sides of the paperboard support member 36 and the side wall portions 35 of the bottom member 25.

When the folding type box-shaped container of Example 1 is fabricated, the bottom member 25 is inserted into the hollow member 21 through the opening portion 22 in the top portion of the hollow member 21 while the side wall portions 35, which define flange of the bottom member 25, are arranged so as to face downward. Since the lingual portions 32 extending from the lower end portions of the side surface portions 24 are folded inwardly, the lingual portions 32 and the side surface portions 24 form "U"-shaped spaces 37. And, the side wall portions 35 of the bottom member 25 are received or secured in the "U"-shaped spaces 37, and the flat plate portion 34 of the bottom member 25 is supported by the ends of the lingual portions 32 (see FIG. 4). The circumferential edge of the flat plate portion 34 is in contact with inner surfaces of the side surface portions 24 of the hollow member 21. The outer surfaces of the side wall portions 35 are in contact with the inner surfaces of the side surface portions 24, and the inner surfaces of the side wall portions 35 are in contact with the inner surfaces of the lingual portions 32. In this state, the lingual portions 32 can be prevented from falling down in the direction of the arrow "E" in FIG. 7, since the paperboard support member 36 is bonded to the lower surface of the flat plate portion 34 so that the end portions of the lingual portions 32 come into contact with the paperboard support member 36 (see FIG. 4) when the lingual portions 32 start to fall down in the direction of "E" in FIG. 7. Further, the lingual portions 32 can be registered in position in the bottom of the hollow member 21. Further, the lid member 23 is fitted onto the top portion of the fabricated container body 20, whereby the opening portion 22 is closed (see FIG. 4).

Figure 4:
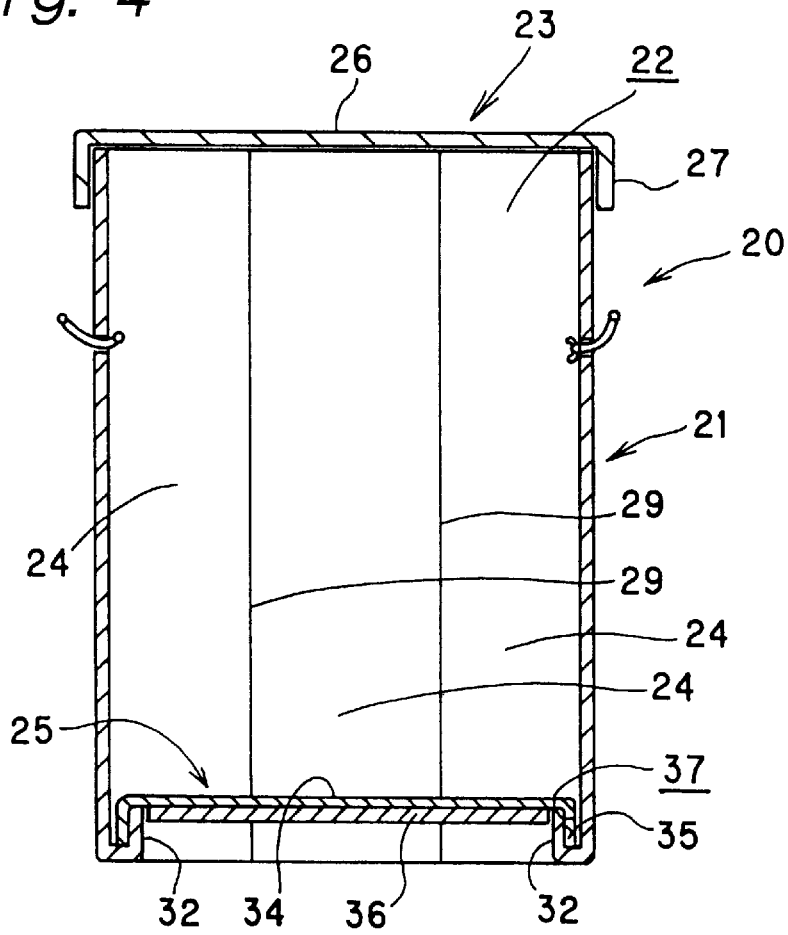
FIG. 4 is a schematic vertical-cut cross-sectional view of the folding type box-shaped container of Example 1.
Figure 9A:
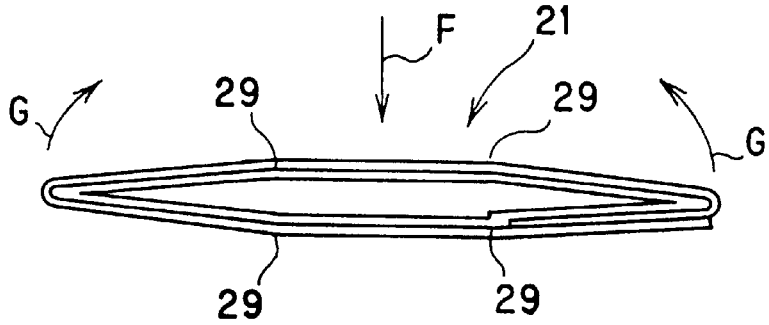
FIGS. 9A and 9B are side views showing the process of folding the hollow member in Example 1.
Figure 9B:
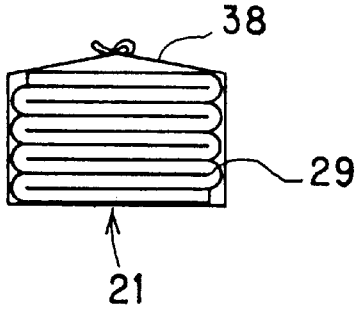
Figure 10:
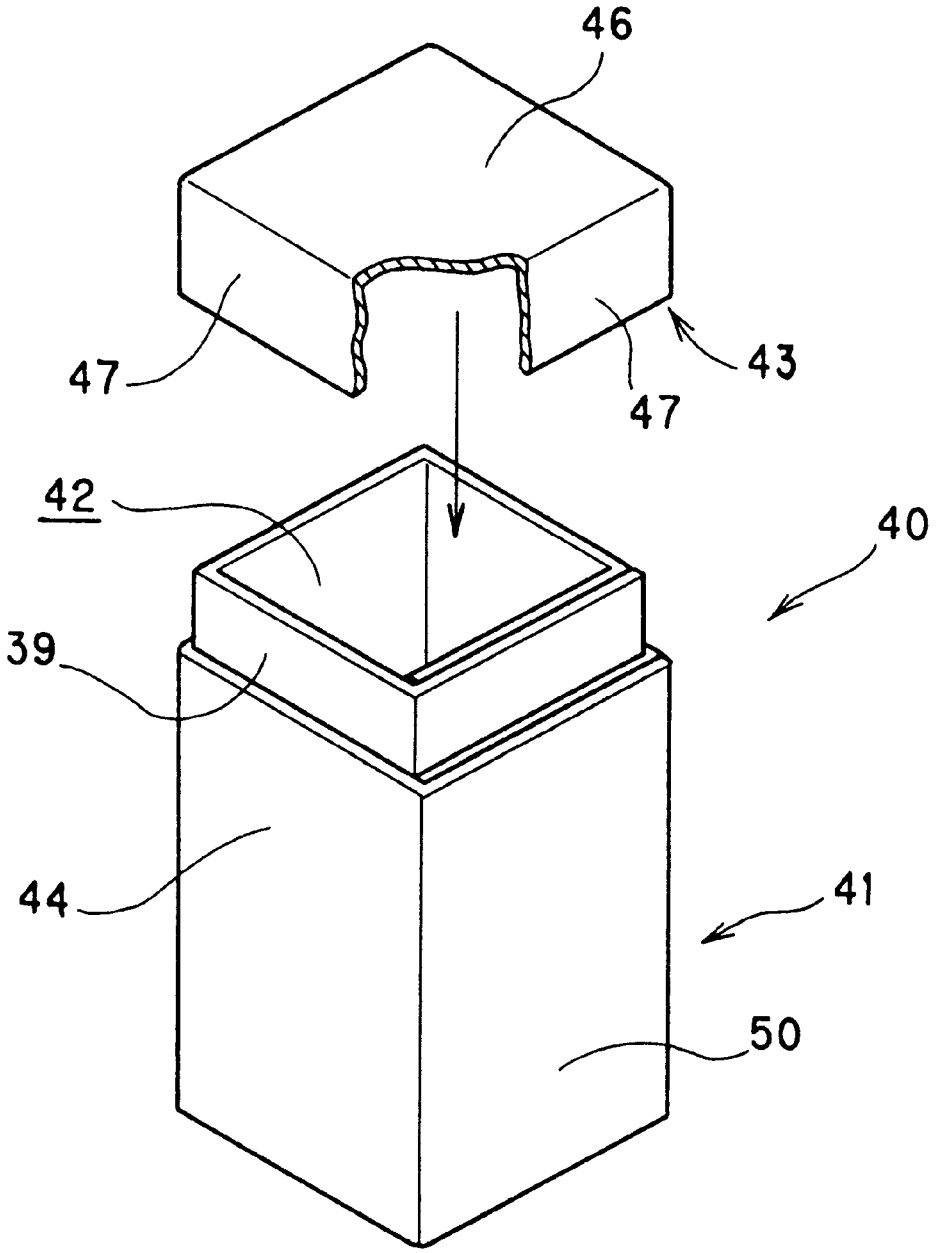
FIG. 10 is a perspective view of the whole of a folding type box-shaped container of Example 2 in which part thereof is cut off.

When the folding type box-shaped container in an assembled state shown in FIG. 4 is disassembled, first, the lid member 23 is removed from the top portion of the container body 20, and then an external force is exerted onto the bottom member 25 from the lower surface side so as to withdraw the side wall portions 35 of the bottom member 25 from the "U"-shaped spaces 37. In this manner, the bottom member 25 is removed from the opening portion 22 of the hollow member 21. Then, an external force is exerted onto the hollow member 21 in the direction of "F" as shown in FIG. 9A, to flatten the hollow member 21. Further, the flattened hollow member 21 can be folded flat along the bending lines 29 in the directions of arrows "G". When the hollow member 21 folded as shown in FIG. 9A is re-assembled, it can be easily re-assembled into a state of the octagonal hollow member 21. Further, when it is disposed of as a waste, the connection margin 30 is peeled off the side surface portion 24 to bring the hollow member 21 back to a band-like member as shown in FIG. 8, and the band-like member can be folded along the bending lines 29 and bound up with a string 38 (see FIG. 9B).

EXAMPLE 2

FIGS. 10 to 18 show a folding type box-shaped container of Example 2. As shown in a perspective view of FIG. 10 in which part is cut off and in a schematic cross-sectional view of FIG. 11, the folding type box-shaped container of Example 2 also comprises a container body 40 and a lid member 43. The container body 40 has a hollow member 41 of which the top and the bottom are open, and a bottom member 45 removably attached to the bottom portion of the hollow member 41. The folding type box-shaped container of Example 2 further has an internal hollow member 39 housed in the hollow member 41. The hollow member 41, the bottom member 45, the lid member 43 and the internal hollow member 39 are made of corrugated paper board material.

Figure 14:
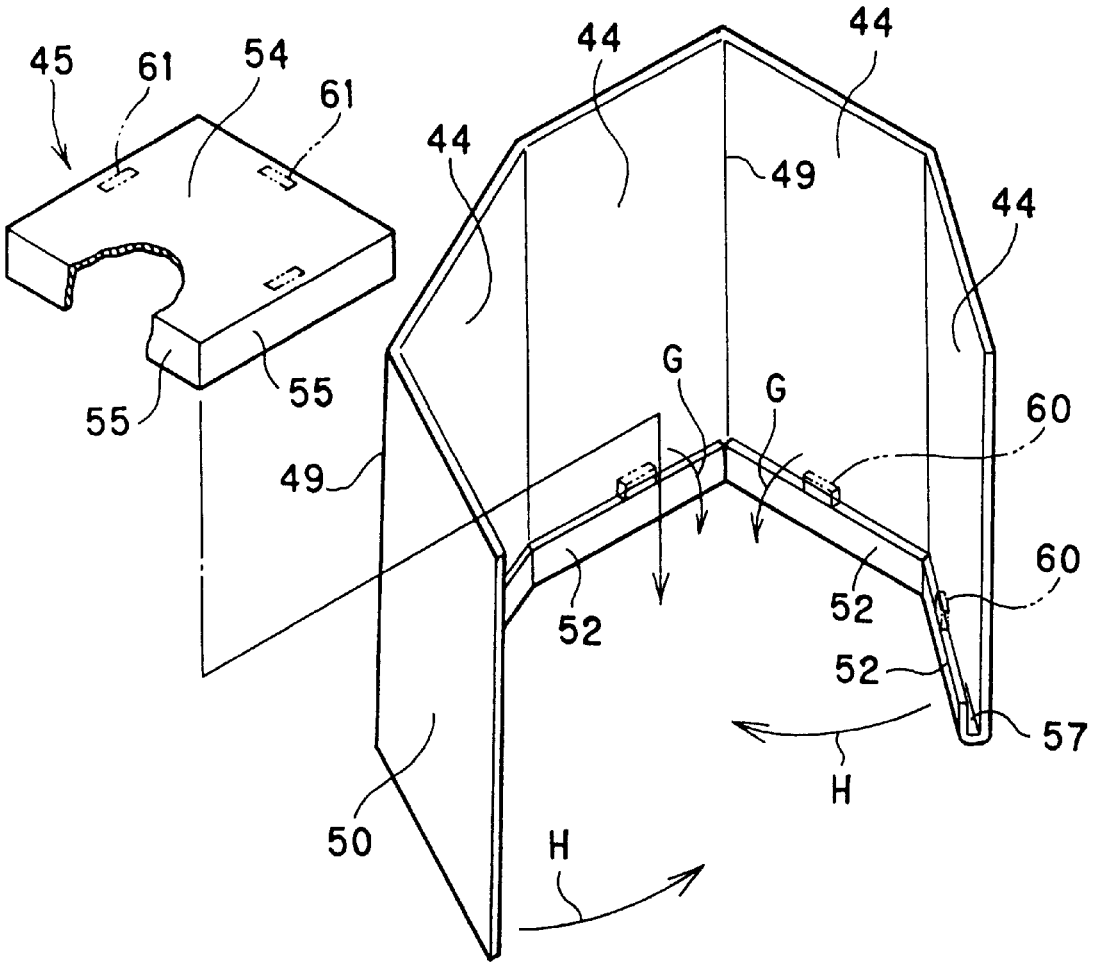
FIG. 14 is a perspective view of the whole of the folding type box-shaped container being assembled in Example 2, in which part is cut off.

The hollow member 41 has a square cross-section when cut through a plane perpendicular to its axial line and has four side surface portions 44 and lingual portions or tongues 52. Each of the lingual portions or tongues 52 extends from the lower end portion of the side surface portion 44, is folded back inward and has two sides and an end. The hollow member 41 is formed by bending a band-like member made of a corrugated paper board material shown in a development of FIG. 15. The band-like member is provided with bending lines 49 at predetermined intervals for sectioning the band-like member into the side surface portions 44. Further, one end (left end portion in FIG. 15) of the band-like member has a connection margin 50, and a bending line 49 is also provided between the connection margin 50 and the side surface portion 44 adjacent thereto. Further, the hollow member 41 has the lingual portions or tongues 52 extending from the lower end portions of the side surface portions 44. The lingual portions or tongues 52 are formed by providing the lower end portions of the side surface portions 44 with slits 53 continued from the bending lines 49, and each lingual portion or tongue 52 has two sides and an end (see FIG. 15). For easily folding the lingual portions 52 back inwardly as shown in FIG. 14, two folding-back lines 54A and 54B are provided between each lingual portions or tongues 52 and each side surface portion 44 (see FIG. 15). The lower end portions of the side surface portions 44 and the lingual portions or tongues 52 are sectioned with the folding-back lines 54A, and the folding-back lines 54B are provided adjacently to, and in parallel with, the folding-back lines 54A and in parallel with the ends of the lingual portions or tongues 52.

Figure 15:
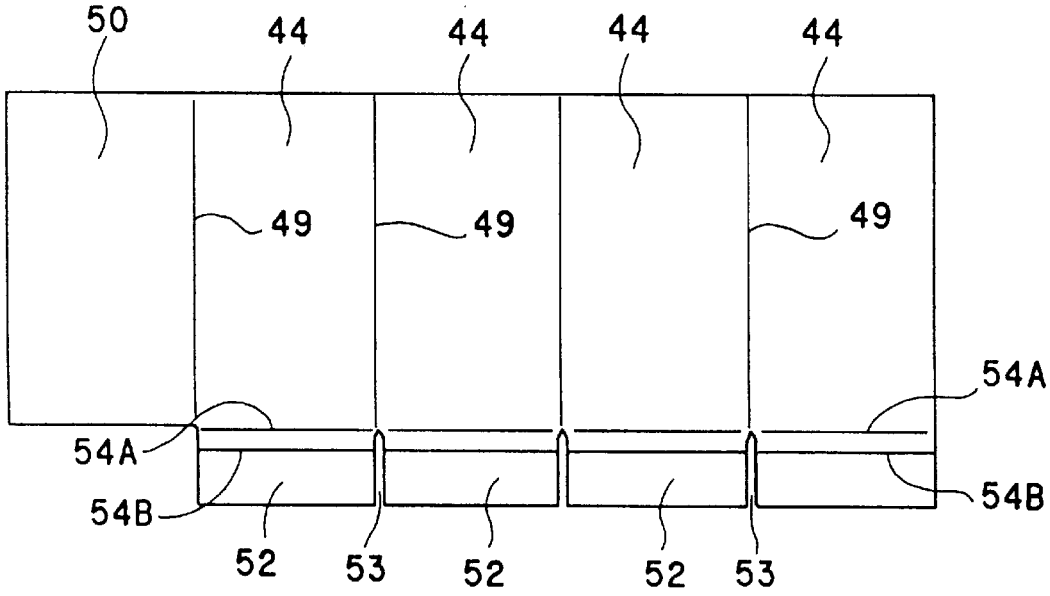
FIG. 15 is a development of a hollow member in Example 2.

When the hollow member 41 is fabricated, first, each lingual portion 52 in a developed state shown in FIG. 15 is folded inwardly along the folding-back lines 54A and 54B in the shape of the letter U. Further, the band-like member is bent inwardly along the bending lines 49 as shown in FIG. 14. The sides of each lingual portion 52 which is folded back in the shape of the letter U are engaged with the sides of the adjacent lingual portions 52 which are also folded back in the shape of the letter U (see FIG. 14). Further, in the above engaged state, mutually adjacent side surface portions 44 are bent along the bending lines 49 in the direction of an arrow "H" (see FIG. 14), i.e., in such a direction that the side surfaces 44 come nearer each other, and the sides of the engaged lingual portions 52 therefore come to "eat in" the sides of the adjacent lingual portions 52. As a result, the lingual portions 52 are prevented from falling down in the direction of the arrow "G", i.e., toward the axial line of the hollow member. The slits 53 provided in the band-like member may be broadened to some extent such that the sides of the adjacent lingual portions 52 which are folded back in the shape of the letter U are engaged with each other when the side surface portions 44 are bent along the bending lines 49 in the direction of the arrow "H" (see FIG. 14).

An adhesive is applied to the inner surface of the connection margin 50 on one end of the band-like member in advance. The band-like member is bent inward along the bending lines 49 (see FIG. 14), and the connection margin 50 and the outer surface of the side surface portion 44 on the other end are attached to each other to bond the connection margin 50 and the side surface portion 44. In the above manner, the hollow member 41 can be fabricated.

Figure 12:
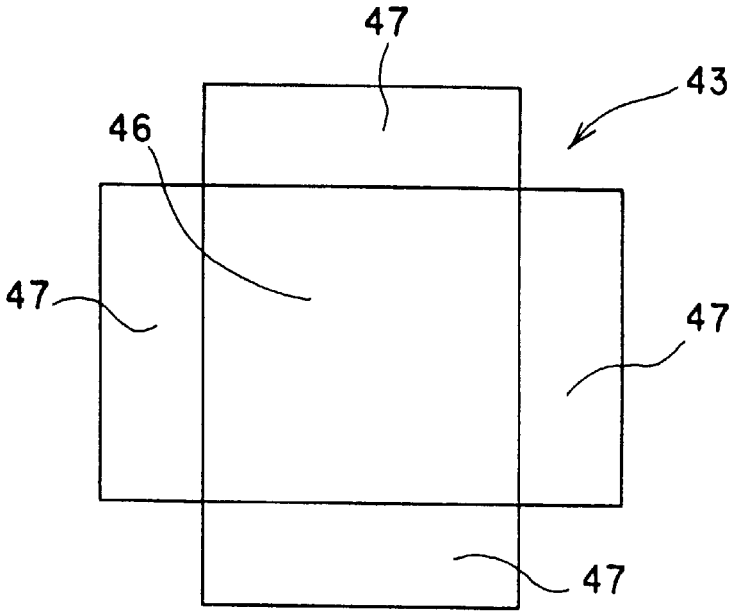
FIG. 12 is a development of a lid member in Example 2.
Figure 13:
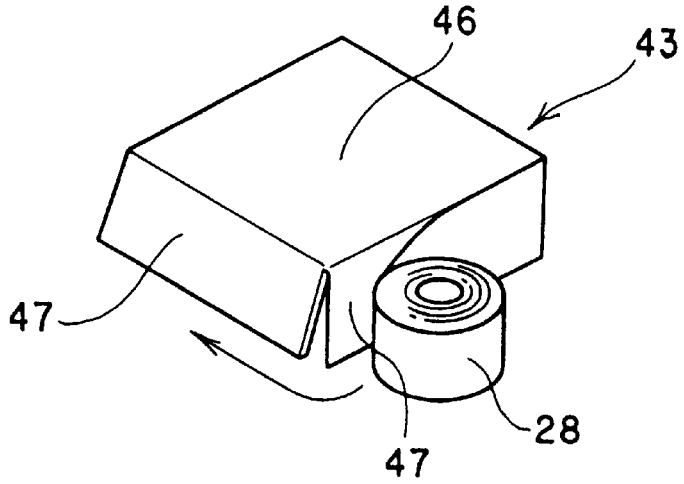
FIG. 13 is a perspective view of the lid member being fabricated in Example 2.

The lid member 43 has a flat plate portion 46 having a square flat form nearly analogous to the cross-sectional form of the hollow member 41 and side wall portions 47 extending downward from the sides of the flat plate portion 46. FIG. 12 shows a schematic plan view of the lid member 43 which is developed before fabricating. FIG. 13 shows a schematic perspective view of the lid member 43 during the fabricating. The side wall portions 47 extending from the sides of the square flat plate portion 46 are bent downwardly, and a paper tape 28 is wound along the outer surfaces of the side wall portions 47, whereby the lid member 43 can be fabricated. The above paper tape 28 may be replaced with a band or the like to fabricate the lid member 43.

Figure 16:
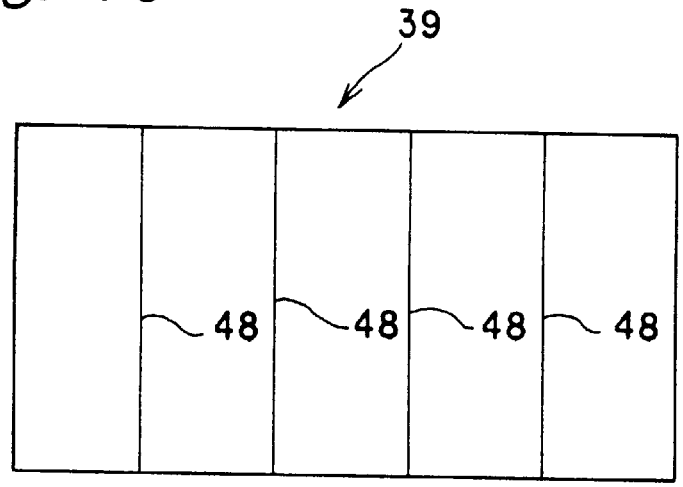
FIG. 16 is a development of an internal hollow member in Example 2.
Figure 17:
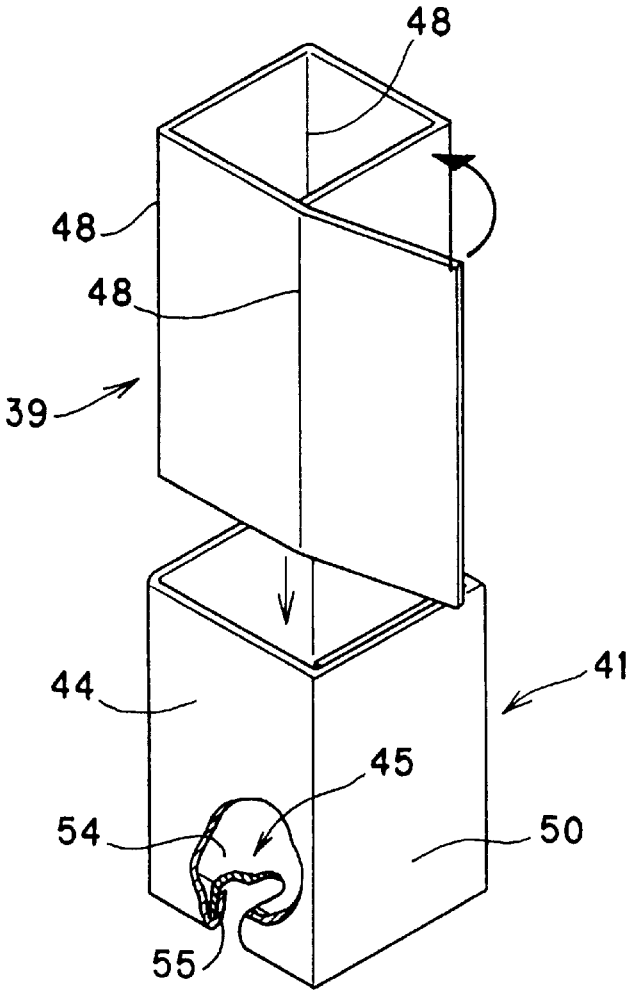
FIG. 17 is a perspective view of the folding type box-shaped container being fabricated in Example 2.

In Example 2, the internal hollow member 39 is provided. The internal hollow member 39 comprises a band-like member as shown in the development of FIG. 16, and the band-like member is sectioned into five sections with four bending lines 48. The band-like member is bent inwardly along the bending lines 48, and a bent portion on the left end side is used as a connection margin. The bent portion on the left end side and a bent portion on the right end side are stacked one on the other to bond them to each other, whereby the internal hollow member 39 can be fabricated (see FIG. 17).

As a perspective view in which part is cut off is shown in FIG. 14, the bottom member 45 has a flat plate portion 54 having a square flat form nearly analogous to the cross-sectional form of the hollow member 41 and side wall portions 55 extending downwardly from the sides of the flat plate portion 54. The developed state of the bottom member 45 is substantially the same as that shown in FIG. 12 except that the dimensions thereof differ.

Figure 11:
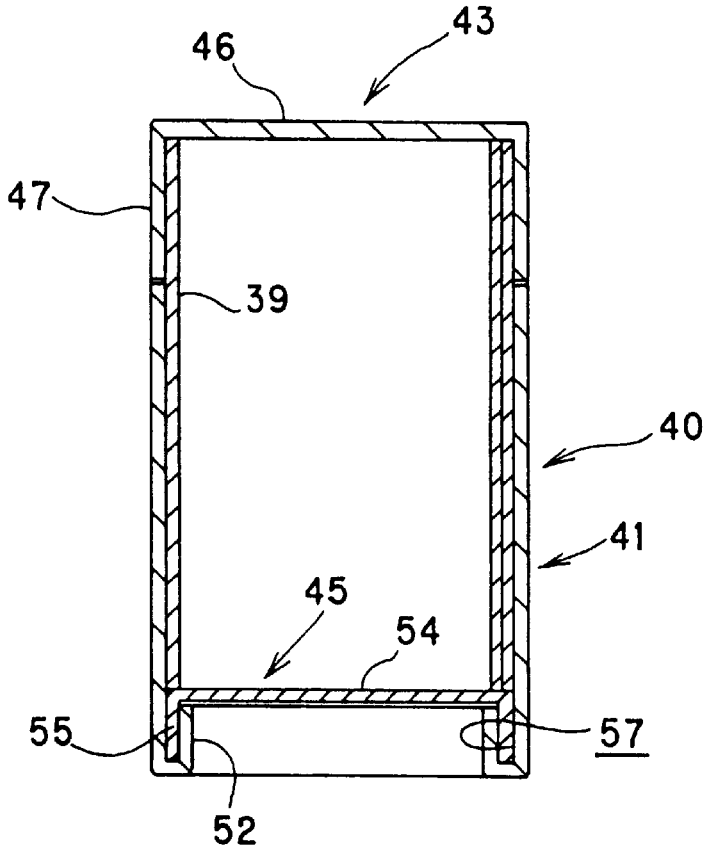
FIG. 11 is a schematic vertical-cut cross-sectional view of the folding type box-shaped container of Example 2.

When the folding type box-shaped container of Example 2 is assembled, the bottom member 45 is inserted into the hollow member 41 through the opening portion 42 in the top portion of the hollow member 41 while the side wall portions 55 of the bottom member 45 are arranged so as to face downwardly. Since the lingual portions 52 extending from the lower end portions of the side surface portions 44 are folded inwardly, the lingual portions 52 and the side surface portions 44 form "U"-shaped spaces 57. And, the side wall portions 55 of the bottom member 45 are received or secured in the "U"-shaped spaces 57, with the flat plate portion 44 of the bottom member 45 is supported by the ends of the lingual portions 52 (see FIG. 11). The circumferential edge of the flat plate portion 54 is in contact with inner surfaces of the side surface portions 44 of the hollow member 41. The outer surfaces of the side wall portions 55 are in contact with the inner surfaces of the side surface portions 44, and the inner surfaces of the side wall portions 55 are in contact with the inner surfaces of the lingual portions 52. Then, the internal hollow member 39 is inserted into the hollow member 41 through the opening portion 42 while the internal hollow member 39 is in contact with the inner surfaces of the side surface portions 44 of the hollow member 41 (see FIGS. 11 and 17). Then, the lower end of the internal hollow member 39 is brought into contact with the flat plate portion 54 of the bottom member 45, whereby the lower end of the internal hollow member 39 is supported on the flat plate portion 54 of the bottom member 45. In this manner, the bottom member 45 can be reliably prevented from moving. The internal hollow member 39 has its upper portion projected above the top end of the hollow member 41 (see FIGS. 10 and 11). The lid member 43 is fitted onto the top portion of the assembled container body 40, i.e., the lid member 43 is covered on the top portion of internal hollow member 39 which is projected above the top end of the hollow member 41, whereby the opening portion 42 is closed (see FIGS. 10 and 11). When the lid member 43 and the internal hollow member 39 are in a fitted state, preferably, the lower ends of the side wall portions 47 of the lid member 43 and the top end of the hollow member 41 are in contact at least partly as shown in FIG. 11. That is, preferably, the side wall portions 47 of the lid member 43 and the internal hollow member 39 are arranged to have lengths so as to accomplish the above state.

Figure 18A:
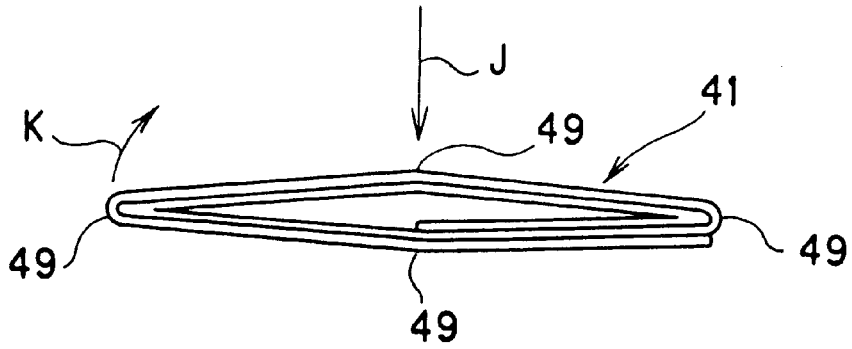
FIGS. 18A and 18B are side views showing the process of folding the hollow member in Example 2.
Figure 18B:
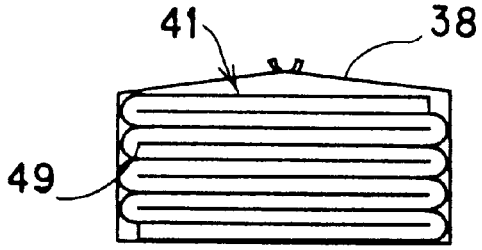

When the folding type box-shaped container in an assembled state as shown in FIG. 11 is disassembled, first, the lid member 43 is removed from the projected top portion of the internal hollow member 39, and then, the internal hollow member 39 is taken out of the hollow member 41. Thereafter, an external force is exerted onto the bottom member 45 from the lower surface side so as to withdraw the lingual portions 52 from the "U"-shaped spaces 57. In this manner, the bottom member 45 is removed from the opening portion 42 of the hollow member 41. Then, an external force is exerted onto the hollow member 41 in the direction of "J" as shown in FIG. 18A, to flatten the hollow member 41. Further, the flattened hollow member 41 can be folded flat along the bending lines 49 in the direction of an arrow "K". When the hollow member 41 is re-used, it can be re-assembled. Further, when it is disposed of as a waste, the connection margin 50 is peeled off the side surface portion 44 to bring the hollow member 41 back to a band-like member as shown in FIG. 15, and the band-like member can be folded along the bending lines 49 and bound up with a string 38 (see FIG. 18B). The internal hollow member 39 can be also similarly folded along the bending lines 48 to flatten it.

EXAMPLE 3

Figure 19:
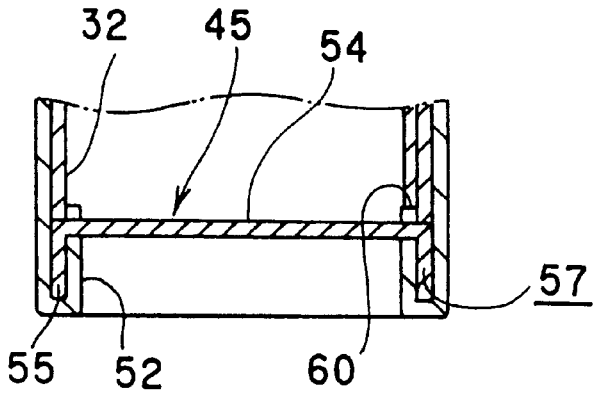
FIG. 19 is a schematic vertical-cut cross-sectional view of part of a folding type box-shaped container of Example 3.
Figure 20:
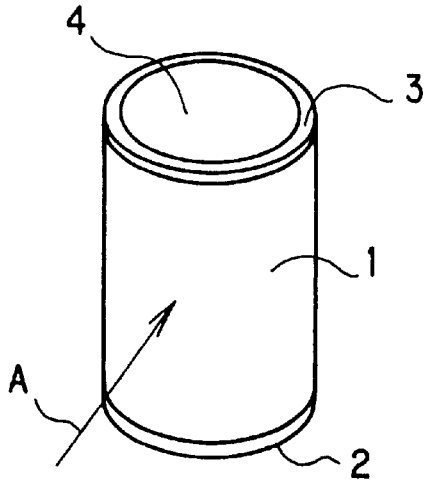
FIG. 20 is a perspective view of a conventional box-shaped container.
Figure 21:
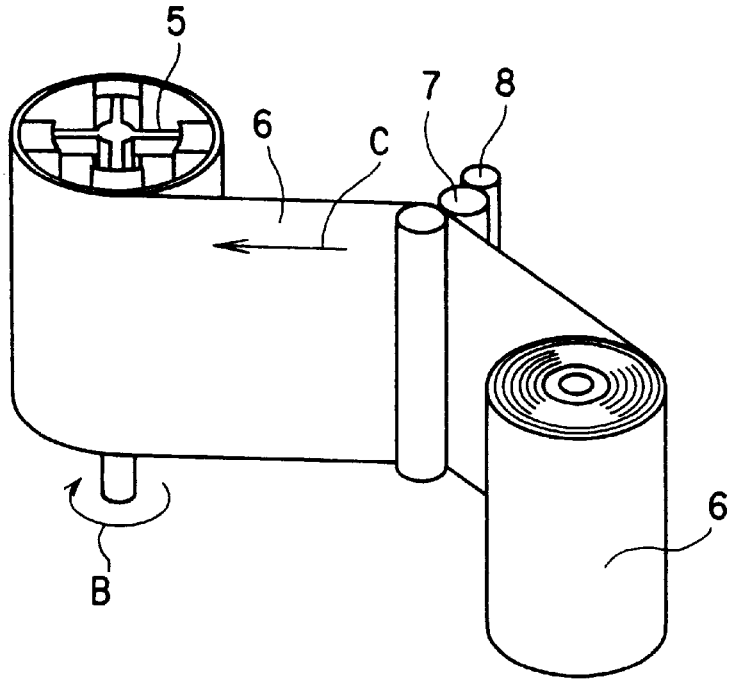
FIG. 21 is a schematic perspective view showing the process of fabricating a cylindrical member of the conventional box-shaped container.
Figure 22:
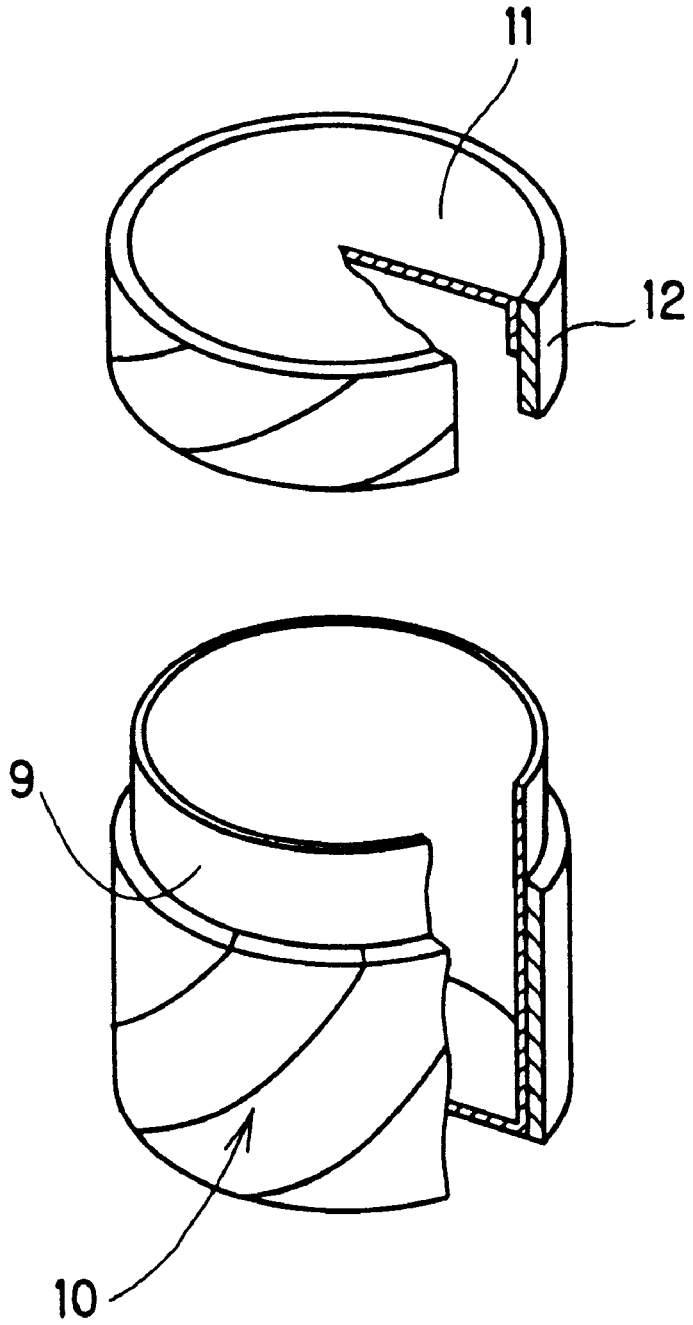
FIG. 22 is a schematic perspective view of other conventional box-shaped container of which part is cut off.

The folding type box-shaped container of Example 3 is a variant of that of Example 2. In Example 3, each lingual portion 52 has a projection 60 in the center of the end thereof (see two-dots chain lines in FIG. 14, and FIG. 19), and the flat plate portion 54 of the bottom member 45 has four holes 61 which are to be fitted onto the four projections 60, respectively (see two-dots chain line in FIG. 14). The projections 60 are upward projections as shown by two-dots chain line in FIG. 14 in an assembly state. The projections 60 are inserted into the holes 61 inside the side portions of the flat plate portion 54 of the bottom member 45 which is inserted from above. As a result, the lingual portions 52 do not fall inwardly and the state of the container body 40 which is assembled can be maintained. Preferably, the sides of the lingual portions 52 which are folded back in the shape of a the letter U are engaged with the sides of adjacent lingual portions 52 which are folded back in the shape of the letter U. Alternatively they may not be engaged. The projections 60 and the holes 61 can be applied to the folding type box-shaped container of Example 1.

The present invention has been explained with reference to Examples, while the present invention shall not be limited thereto. In Examples, N=4 and N=8 are employed, while N=5, 6, 7, 9 . . . may be employed. In view of ease in folding along the bending lines 29 and 49 shown in FIGS. 9 and 18, however, it is preferred to use band-like members which give corners of even numbers such as a square (N=4), a hexagon (n=6), an octagon (N=8) and the like. When the hollow members 21 and 41 and the internal hollow member 39 are fabricated from the band-like members, it is not necessarily required to provide a connection margin on the band-like member, and for example, one end and the other end of the band-like member may be bonded to each other with a tape, etc., while they are abutted or in contact, or they may be bonded to each other with an auxiliary paper board and the like.

As described above, according to the folding type box-shaped container of the present invention, the assembling and the disassembling can be easily carried out, and the container is not bulky in its disassembled state, so that its transportation for returning it and the disposal thereof can be eased. Further, the folding type box-shaped container of the present invention can be easily assembled on site where it is used. Moreover, after use, it can be easily disassembled and easily returned to a supplier3 s plant and the like, which can achieve recycle of the container. Furthermore, it is not bulky in its return, which can reduces a transportation cost. When it is disposed of as a waste, further, it is not bulky, and the waste can be compacted. Further, all the members including the lid member can be made of paper, and they can be recycled.

What is claimed is:

1. A container comprising:

a hollow member having a plurality of sides defining a container body having a polygonal cross sectional shape, a first open end and a second open end;

tongues at end portions of said plurality of sides, respectively, wherein said tongues extend inwardly from respective ones of said plurality of sides and then in a direction towards said second open end, such that a first space is formed between said tongues and said plurality of sides;

a first closure member removably attachable to said hollow member to close said first open end, wherein said first closure member includes a polygonal plate having a perimeter corresponding in shape to the cross sectional shape of the container body and a flange extending about the perimeter of said polygonal plate; and a support member having a perimeter smaller than the perimeter of said polygonal plate, and being attached to said polygonal plate internally of said flange such that a second space is formed between said support member and said flange, such that when said flange is received within said first space, said tongues are received within said second space.

2. The container according to claim 1, and further comprising a second closure member removably attachable to said hollow member to close said second open end.

3. The container according to claim 1, wherein said first open end defines a bottom of the container body and said second open end defines a top of the container body.

4. The container according to claim 1, wherein said plurality of sides includes at least four sides.

5. The container according to claim 1, wherein said support member comprises paperboard.

6. The container according to claim 5, wherein said support member is bonded to said polygonal plate.

7. The container according to claim 1, wherein said support member is bonded to said polygonal plate.

8. The container according to claim 1, wherein said flange comprises a plurality of wall portions, with each wall portion extending away from a corresponding portion of the perimeter of said polygonal plate.

9. The container according to claim 1, wherein said tongues terminate at terminal surfaces, respectively, and wherein said flange is of a length such that when said flange is received within said first space said polygonal plate is supported by the terminal surfaces of said tongues.

10. The container according to claim 1, wherein said hollow member comprises a bendable material.

11. The container according to claim 1, wherein said tongues comprise folded extensions of said plurality of sides, respectively.

12. A folding type box-shaped container comprising:

a hollow member having at least four sides defining a container body having a polygonal cross sectional shape, an open bottom and an open top;

tongues at end portions of said plurality of sides, respectively, wherein said tongues include folded extensions of said plurality of sides, respectively, and extend inwardly from respective ones of said plurality of sides and then in a direction towards said open top, such that a first space is formed between said tongues and said plurality of sides;

a bottom member removably attachable to said hollow member to close said open bottom, wherein said bottom member includes a polygonal plate having a perimeter corresponding in shape to the cross sectional shape of the container body and wall portions extending about the perimeter of said polygonal plate;

a lid member removably attachable to said hollow member to close said open top; and a lid member removably attachable to said hollow member to close said open top; and a paperboard member having a perimeter smaller than the perimeter of said polygonal plate, and being bonded to said polygonal plate internally of said wall portions such that a second space is formed between said paperboard member and said wall portions, such that when said wall portions are received within said first space, said tongues are received within said second space and support said polygonal plate.

13. The folding type box-shaped container according to claim 12, wherein said tongues each include a first side and a second side, with the first side of each tongue engaging the second side of an adjacent tongue.

14. The folding type box-shaped container according to claim 12, wherein said tongues include projections extending from end surfaces thereof, respectively, and said polygonal plate has holes adapted to receive said projections, respectively.

15. The folding type box-shaped container according to claim 12, wherein said lid member includes a polygonal plate having a perimeter corresponding in shape to the cross sectional shape of the container body and wall portions extending about the perimeter of said polygonal plate.

16. The folding type box-shaped container according to claim 12, wherein said at least four sides includes an even number of sides.

17. A container, comprising:

a first hollow member having a plurality of sides defining a container body having a polygonal cross sectional shape, a first open end and a second open end;

tongues at end portions of said plurality of sides, respectively, wherein said tongues extend inwardly from respective ones of said plurality of sides and then in a direction towards said second open end, such that a space is formed between said tongues and said plurality of sides;

a first closure member removably attachable to said hollow member to close said first open end, wherein said first closure member includes a polygonal plate having a perimeter corresponding in shape to the cross sectional shape of the container body and a flange extending about the perimeter of said polygonal plate, with said flange to be received within said space when said first closure member is attached to said first hollow member to close said first open end; and a second hollow member locatable within said first hollow member, with a first end of said second hollow member to be positioned against said polygonal plate and a second end of said second hollow member to extend beyond said second open end when said first closure member is attached to said first hollow member to close said first open end.

18. The container according to claim 17, wherein said plurality of sides includes at least four sides.

19. The container according to claim 17, wherein said tongues comprise folded extensions of said plurality of sides, respectively.

20. The container according to claim 17, and further comprising a second closure member removably attachable to said second hollow member to close said second open, wherein said second closure member includes a polygonal plate having a perimeter corresponding in shape to the cross sectional shape of the container body and wall portions extending about the perimeter of said polygonal plate.

21. The container according to claim 17, wherein said first open end defines a bottom of the container body and said second open end defines a top of the container body.

22. The container according to claim 17, wherein said flange comprises a plurality of wall portions, with each wall portion extending away from a corresponding portion of the perimeter of said polygonal plate.

23. The container according to claim 17, wherein said tongues terminate at terminal surfaces, respectively, and wherein said flange is of a length such that when said flange is received within said first space said polygonal plate is supported by the terminal surfaces of said tongues.

24. The container according to claim 17, wherein said first hollow member comprises a bendable material.

25. A folding type box-shaped container, comprising:

a first hollow member having at least four sides defining a container body having a polygonal cross sectional shape, an open bottom and an open top;

tongues at end portions of said plurality of sides, respectively, wherein said tongues include folded extensions of said plurality of sides, respectively, and extend inwardly from respective ones of said plurality of sides and then in a direction towards said open top, such that a space is formed between said tongues and said plurality of sides;

a bottom member removably attachable to said first hollow member to close said open bottom, wherein said bottom member includes a polygonal plate having a perimeter corresponding in shape to the cross sectional shape of the container body and wall portions extending about the perimeter of said polygonal plate, with said wall portions to be received within said space when said bottom member is attached to said first hollow member to close said open bottom;

a second hollow member locatable within said first hollow member, with a first end of said second hollow member to be positioned against said polygonal plate and a second end of said second hollow member to extend beyond said open top when said bottom member is attached to said first hollow member to close said open bottom; and a lid member removably attachable to said second hollow member to close said open top, wherein said lid member includes a polygonal plate having a perimeter corresponding in shape to the cross sectional shape of the container body and wall portions extending about the perimeter of said polygonal plate.

26. The folding type box-shaped container according to claim 25, wherein lower ends of said wall portions of said lid member are to contact an upper end of said first hollow member when said lid member is attached to said second hollow member to close said open top.

27. The folding type box-shaped container according to claim 26, wherein said tongues each include a first side and a second side, with the first side of each tongue engaging the second side of an adjacent tongue.

28. The folding type box-shaped container according to claim 26, wherein said tongues include projections extending from end surfaces thereof, respectively, and said polygonal plate has holes adapted to receive said projections, respectively.

29. The folding type box-shaped container according to claim 26, wherein said at least four sides includes an even number of sides.

* * * * *